US009295290B1

(12) United States Patent
Solorzano

(10) Patent No.: US 9,295,290 B1
(45) Date of Patent: Mar. 29, 2016

(54) GARMENT TO SELECTIVELY ACCESS PREDETERMINED AREAS ON AN INFANT'S BODY DURING MEDICAL PROCEDURES

(71) Applicant: Rosa Solorzano, Lehigh Acres, FL (US)

(72) Inventor: Rosa Solorzano, Lehigh Acres, FL (US)

(73) Assignee: Rosa Solorzano, Lehigh Acres, FL (US)

( * ) Notice: Subject to any disclaimer, the term of this patent is extended or adjusted under 35 U.S.C. 154(b) by 0 days.

(21) Appl. No.: 14/445,057

(22) Filed: Jul. 29, 2014

(51) Int. Cl.

| | |
|---|---|
| ***A41D 11/00*** | (2006.01) |
| ***A41D 15/00*** | (2006.01) |
| ***A41D 15/04*** | (2006.01) |
| ***A41B 13/00*** | (2006.01) |
| ***A41D 13/00*** | (2006.01) |

(52) U.S. Cl.
CPC ..... *A41D 11/00* (2013.01); *A41B 13/005* (2013.01); *A41D 13/0002* (2013.01); *A41D 15/00* (2013.01); *A41D 15/002* (2013.01); *A41D 15/005* (2013.01); *A41D 15/007* (2013.01); *A41D 15/04* (2013.01)

(58) Field of Classification Search
CPC ..... A41B 1/00; A41B 13/005; A41D 15/04; A41D 15/002; A41D 15/00; A41D 15/005; A41D 15/007; A41D 13/0002
USPC ..... 2/125, 126, 69.5, 129, 70, 119
See application file for complete search history.

(56) References Cited

U.S. PATENT DOCUMENTS

| | | | | | |
|---|---|---|---|---|---|
| 945,980 | A * | 1/1910 | Paradis | 2/125 |
| 1,045,737 | A * | 11/1912 | Paradis | 2/126 |
| 1,066,219 | A * | 7/1913 | Paradis | 2/126 |
| 1,658,897 | A * | 2/1928 | Hessen | 2/125 |
| 2,040,029 | A * | 5/1936 | Smutny | 2/89 |
| 2,177,587 | A * | 10/1939 | Woelfel, Sr. | 2/269 |
| 2,469,700 | A * | 5/1949 | Petroceill | 2/69.5 |
| 2,496,922 | A * | 2/1950 | Virtue | 2/69.5 |
| 2,670,470 | A * | 3/1954 | Manheim et al. | 2/70 |
| 2,675,552 | A * | 4/1954 | Jackson | 2/69.5 |
| 2,680,849 | A * | 6/1954 | Munro | 2/69.5 |
| 3,002,193 | A * | 10/1961 | Briskman | 2/72 |
| 3,082,764 | A * | 3/1963 | Galanis | 128/881 |
| 4,006,495 | A * | 2/1977 | Jones | 2/93 |
| 4,261,059 | A * | 4/1981 | Spitz | 2/108 |
| 4,347,629 | A * | 9/1982 | Itoi | 2/108 |
| 4,408,356 | A * | 10/1983 | Abrams | 2/87 |
| 4,507,805 | A * | 4/1985 | Calutoiu | 2/69.5 |
| 4,573,218 | A * | 3/1986 | Saggs | 2/93 |
| 5,023,953 | A * | 6/1991 | Bettcher | 2/126 |
| 5,131,096 | A * | 7/1992 | Olson | 2/75 |
| 5,226,193 | A * | 7/1993 | Chen | 2/69.5 |
| 5,692,239 | A * | 12/1997 | Lewis | 2/125 |
| 5,815,833 | A * | 10/1998 | Kuo | 2/69.5 |
| 7,178,185 | B1 * | 2/2007 | Nattler | 5/482 |
| 7,647,656 | B2 * | 1/2010 | Smith | 5/413 R |
| 2008/0078027 | A1 * | 4/2008 | Smith | 5/413 R |
| 2014/0165257 | A1 * | 6/2014 | Wynh | 2/69.5 |

* cited by examiner

*Primary Examiner* — Shaun R Hurley
*Assistant Examiner* — Bao-Thieu L Nguyen
(74) *Attorney, Agent, or Firm* — Christian Sanchelima; Jesus Sanchelima

(57) ABSTRACT

A garment used to maintain users at a desired temperature during medical procedures. The garment provides openings at predetermined areas of the material to allow a user to be comfortably positioned and provide medical practitioners with access to the body while keeping the user at a desired temperature.

10 Claims, 12 Drawing Sheets

GARMENT TO SELECTIVELY ACCESS PREDETERMINED AREAS ON AN INFANT'S BODY DURING MEDICAL PROCEDURES

BACKGROUND OF THE INVENTION

1. Field of the Invention

The present invention relates to a garment that allows a user to selectively expose predetermined areas of an infant's body.

2. Description of the Related Art

Several garments for infants have been designed in the past. None of them, however, include the versatility to access as many predetermined selected areas of an infant's body without exposing the remaining areas, thus maintaining the baby's body warmer. A related reference is U.S. Pat. No. 8,607,364 filed on Feb. 14, 2009 and issued to Karen Barski for an ergonomic swaddling garment. The Barski reference teaches of sleeves that can be attached or detached from the garment. However, it differs from the present invention because it does not disclose a way to access specific areas along an infant's arm while keeping covered the remaining areas along the arm. In order to access certain areas along an infant's arm, a user would have to detach the entire sleeve in the Barski reference. Thus, leaving the rest of the arm exposed and a baby cold. The present invention teaches of a garment using fastening means along the entire length of each sleeve. This provides a way for a user to access any area along an infant's arm and maintain the rest of the body covered. In addition, the present invention solves this unaddressed problem in a more practical way than the Barski reference that employs the use of several components. Also, the present invention teaches of hand covers at the distal ends of the sleeve assembly, which are not taught in the prior art.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a garment that maintains an infant's body covered while a user, such as a nurse, selectively accesses different parts of an infant's body.

It is another object of this invention to provide a garment that is made of one piece to allow practical means of covering and accessing specific areas of the infant's body only.

It is still another object of the present invention to provide a garment that has sleeves that can be tucked within the garment.

It is another object of the present invention to provide hand coverings at the distal ends of the garment's sleeves to cover an infant's hands.

It is still another object of the present invention to provide a garment that has sleeves that can be brought outside of the garment to facilitate movement for an infant while still being able to cover the remaining parts of the body.

It is still another object of the present invention to provide a garment that maintains an infant warm and comfortable during medical procedures.

It is yet another object of this invention to provide such a garment that is inexpensive to manufacture and implement while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
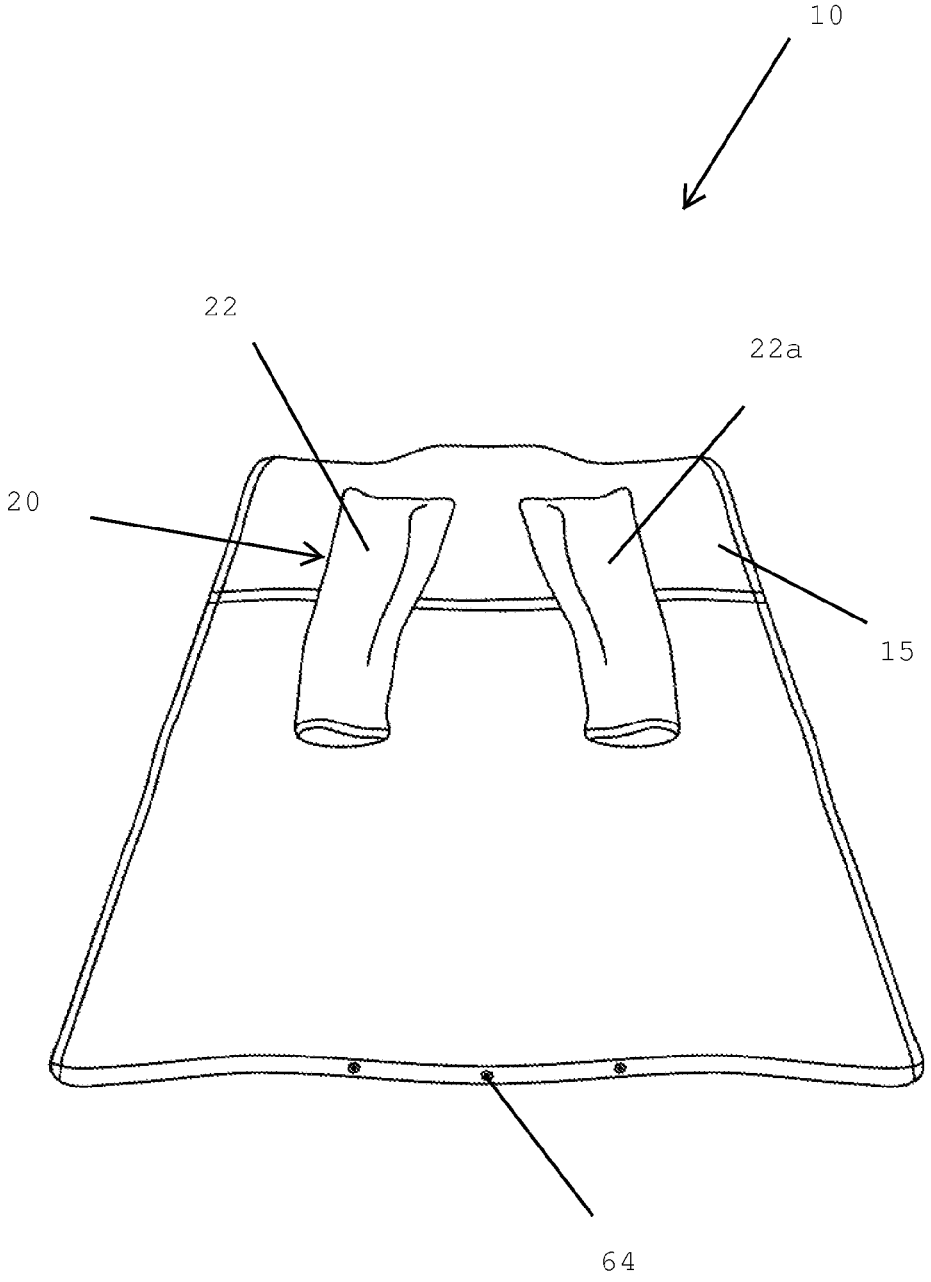
FIG. 1 represents an inclined view of an embodiment of the present garment wherein sleeves 22; 22*a* can be seen mounted to and extending from inner surface 15. Lower fastening means 66 are partially shown.

Referring now to the drawings, where the present invention is generally referred to with numeral 10, it can be observed that it basically includes sleeve assembly 20, upper portion assembly 40, and lower portion assembly 60.

Sleeve assembly 20 includes sleeves 22; 22*a* as seen in FIG. 1. As shown in FIG. 1, sleeves 22; 22*a* are mounted to garment inner surface 15. Mounting sleeves 22; 22*a* in this manner allow them to be tucked in the garment and further covered when upper portion assembly 40 is closed.

Figure 2:
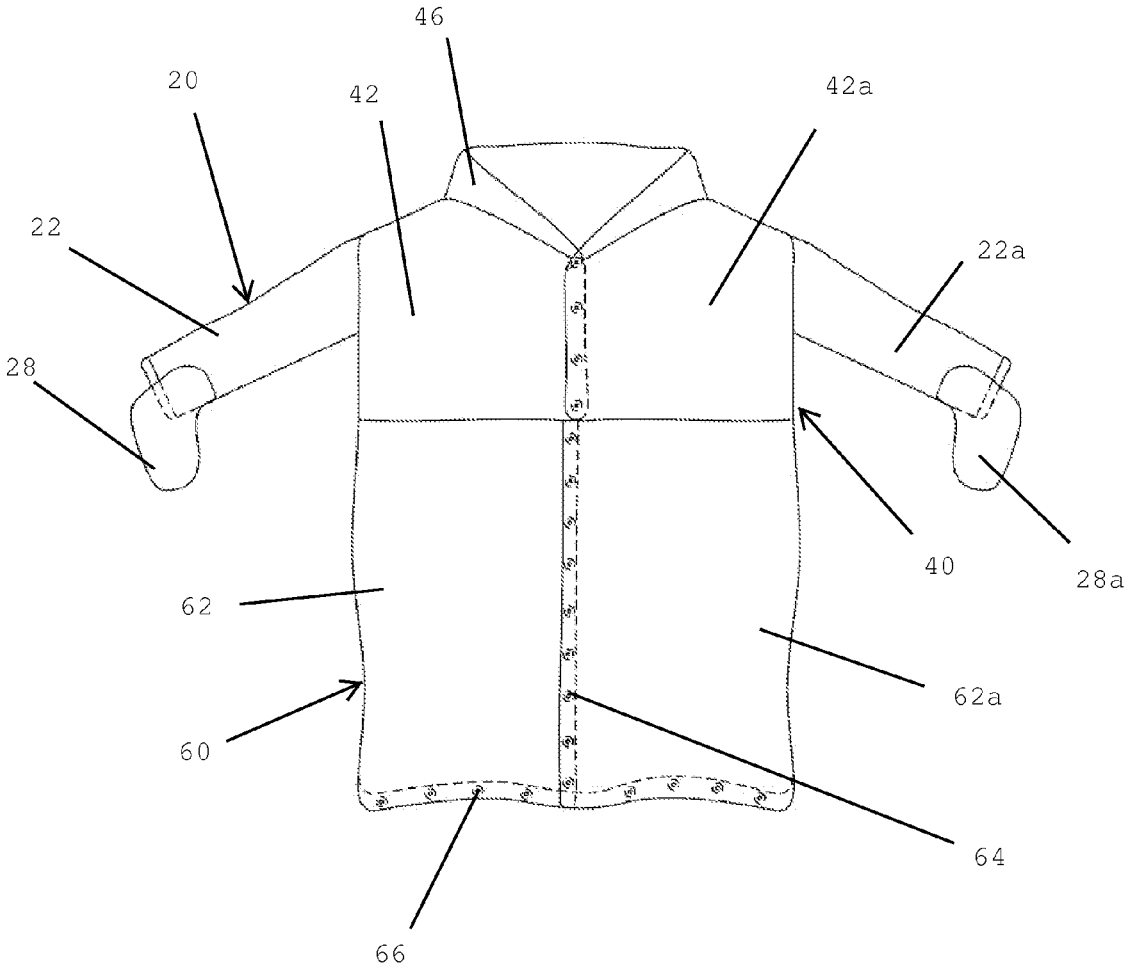
FIG. 2 represents a front view of the present invention wherein sleeves 22; 22*a* are seen extending outwardly from upper flaps 42; 42*a* through side openings 27; 27*a* (shown in FIG. 2A) allowing a user a different positioning for an infant's arm. In addition, hand covers 28; 28*a* can be used to cover an infant's hands.
Figure 2A:
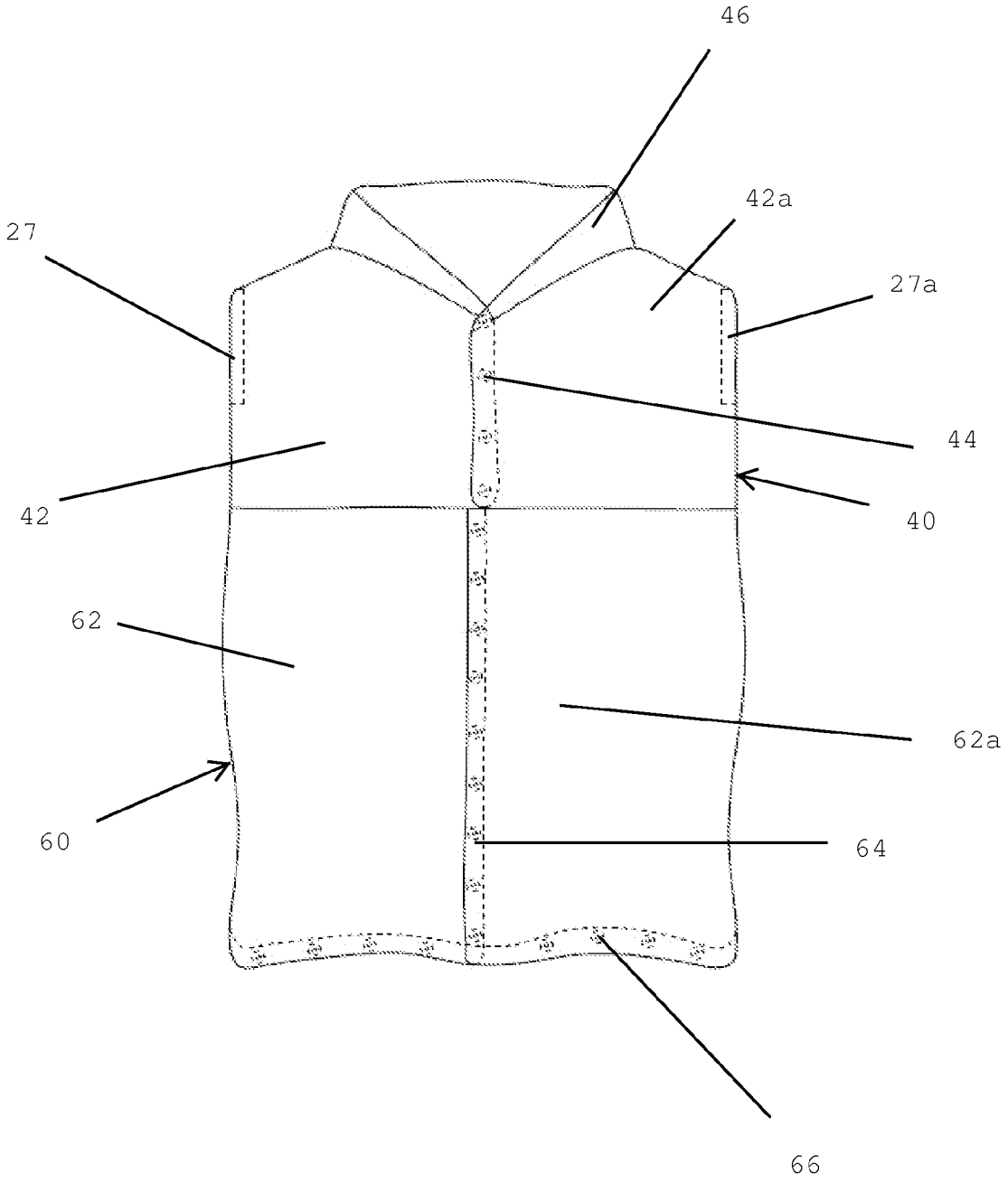
FIG. 2A represents a front view of the present invention showing lower flap assembly 60 in the closed position and fastened using lower flap fastening means 64. In addition, side openings 27; 27*a* can be seen so that sleeves 22; 22*a* (shown in FIG. 2) can be extended through the sides of the garment.

As shown in FIGS. 2 and 2A, sleeves 22; 22*a* can be passed through side openings 27; 27*a* to extend out of the sides of the garment, providing another option to position an infant's arms. Also, the distal ends of sleeves 22; 22*a* include hand coverings 28; 28*a*, respectively, that enclose an infant's hands to provide warmth.

Figure 3:
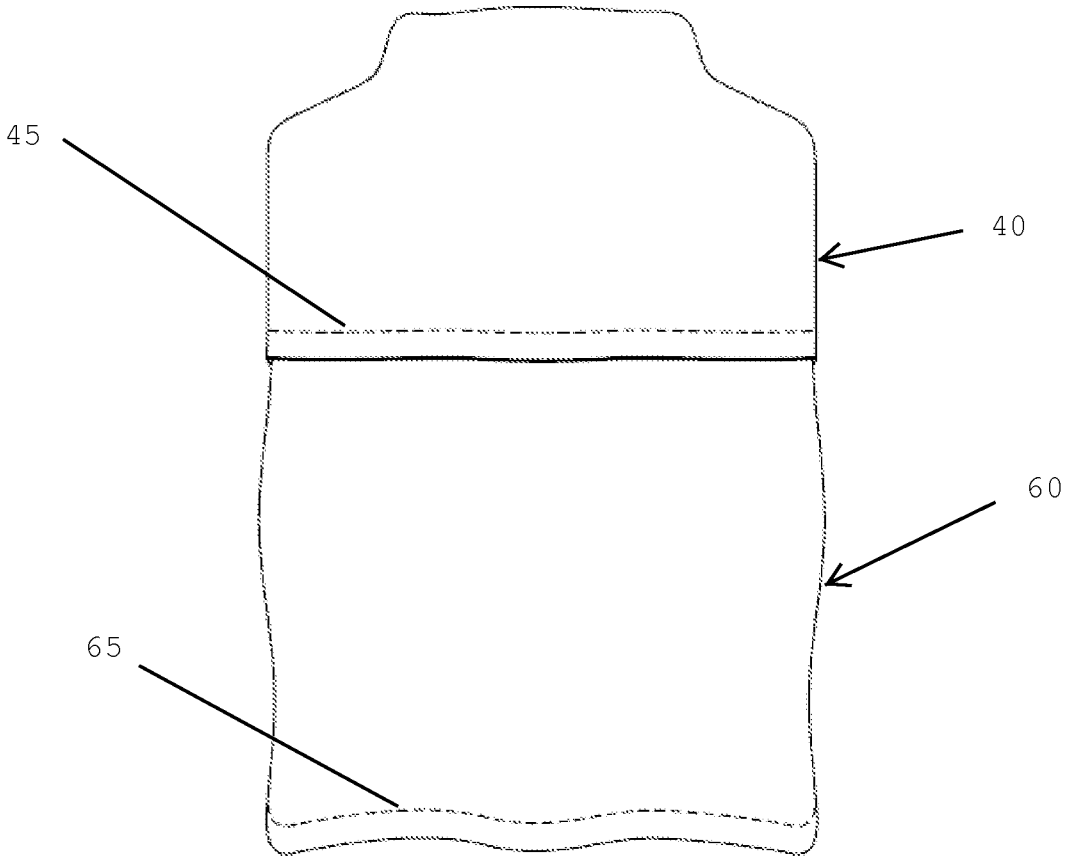
FIG. 3 illustrates a rear view of the present embodiment showing the back of upper portion assembly 40 and the back of lower portion assembly 60, upper portion stitching 45 can be seen mounting upper portion assembly 40 to lower portion assembly 60. Further, lower stitching 65 is used to uniformly tuck in the fabric of the garment and keep it in place.

FIG. 3 shows a rear view of upper portion assembly 40 mounted to lower portion assembly 60. In one embodiment, shown in FIG. 3, this attachment is done using upper portion stitching 45. Bottom portion stitching 65 is uses to uniformly tuck in the bottom ends of the fabric.

Figure 4:
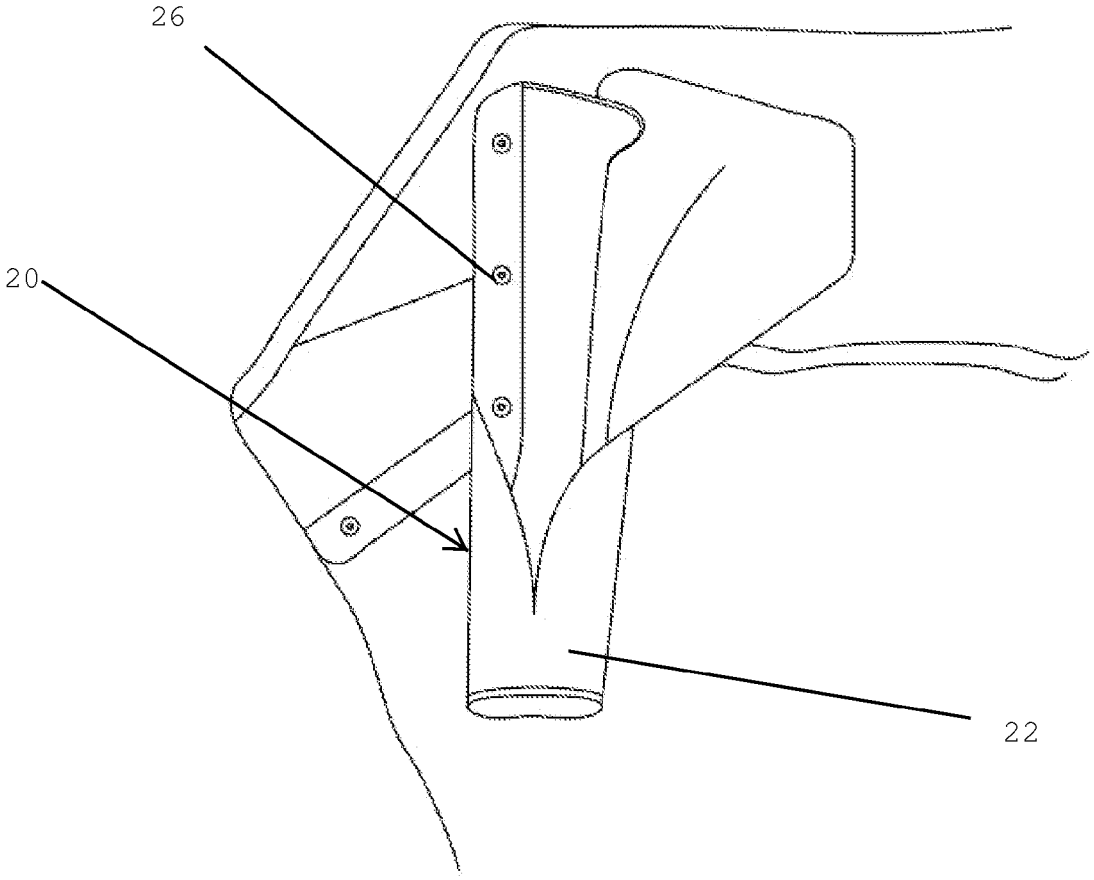
FIG. 4 is a front view of an alternate embodiment not using hand covers 28; 28*a*, wherein sleeve fastening members 26 are snap buttons and in the open position allowing access to select areas of an infant's arms.
Figure 4A:
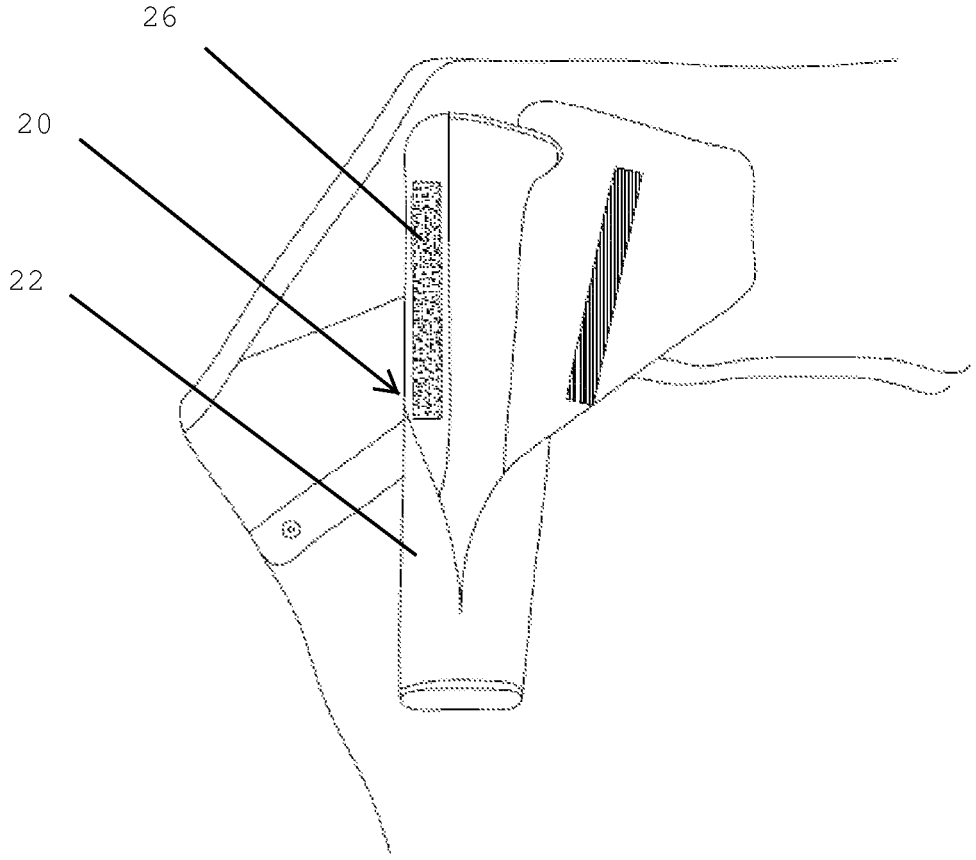
FIG. 4A is a front view of an alternate embodiment not using hand covers 28; 28*a*, wherein sleeve fastening members 26 are hook and loop fasteners and in the open position allowing access to select areas of an infant's arms.

As shown in FIG. 4, sleeve assembly 20 includes sleeve fastening means 26 to allow a user to selectively open and close predetermined areas along sleeves 22; 22*a*. In an alternate embodiment shown in FIG. 4A, hook and loop fasteners can be used as fastening means 26. The above-mentioned fastening means have been chosen because they readily allow a user to open select parts of sleeve assembly 20 while maintaining the rest of the infant's arms covered, thereby helping to maintain the body temperature as stable as possible.

Figure 5:
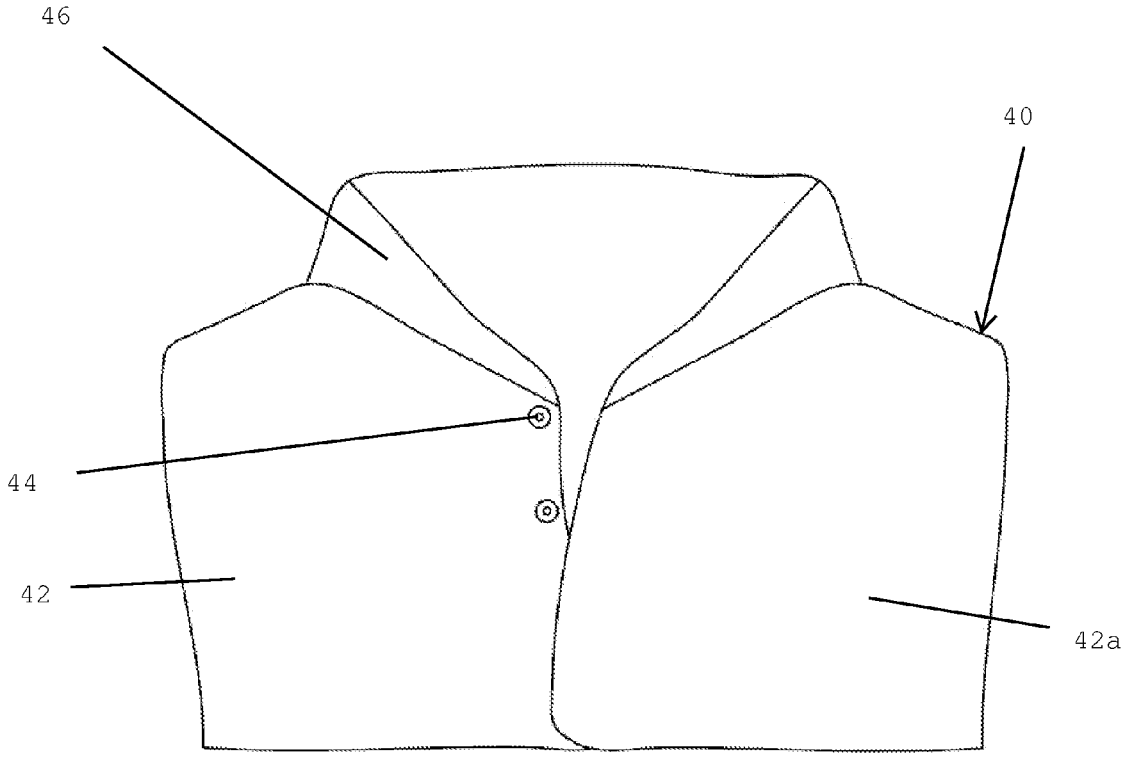
FIG. 5 shows a front view of garment 10 being folding and showing upper portion assembly 40 wherein upper flap fastening means 44 are partially open allowing access to select areas of an infant's chest.
Figure 9:
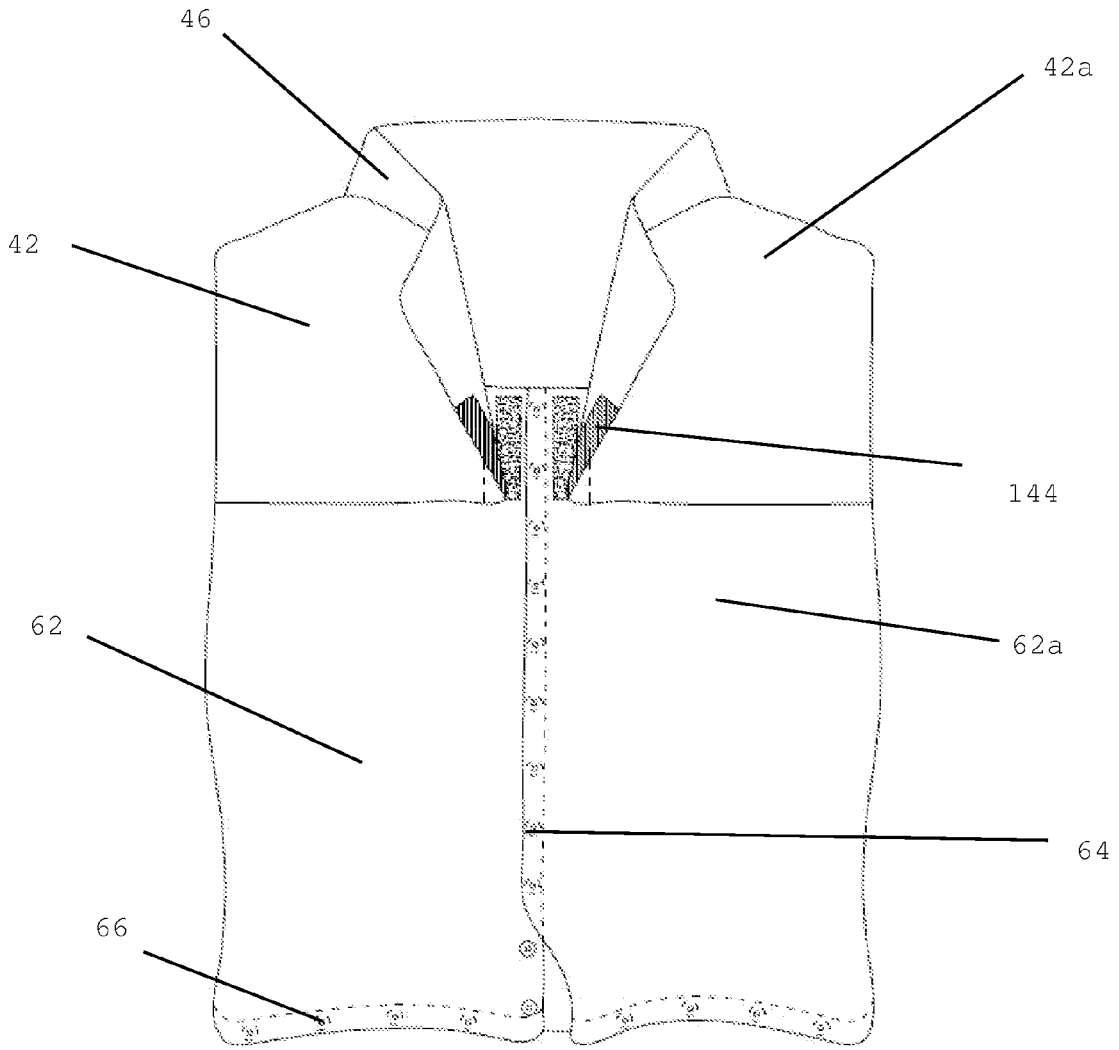
FIG. 9 shows a front view of an alternate embodiment of the present invention wherein hook and loop fasteners 144 are used to attach upper flaps 42; 42*a* to lower flaps 62; 62*a*, respectively, allowing a user to maintain one side closed while working on the opposite side. Lower flaps 62; 62*a* are in the substantially closed position using snap buttons as lower fastening means 64.

As seen in FIG. 5, upper portion assembly 40 includes upper flaps 42; 42*a* of substantially equal dimensions that primarily cover an infant's chest. Upper flaps 42; 42*a* can be fastened together using upper flap fastening means 44. Upper flap fastening means 44 may be sew-through buttons, hook and loop fasteners, or snap buttons as shown in FIGS. 2 and 5-7. Upper portion assembly 40 further includes collar 46 that extends from the top ends of upper flaps 42; 42*a* and continues around the circumference of an infant's neck to provide it with greater warmth. In an alternate embodiment shown in FIG. 9, upper flap fastening means 144 can be used to secure top flaps 42; 42*a* to lower flaps 62; 62*a*, respectively.

This is done so that a user can maintain one side closed and the infant warm while being able to open the opposite flap to access an area on the infant's upper body.

Figure 6:
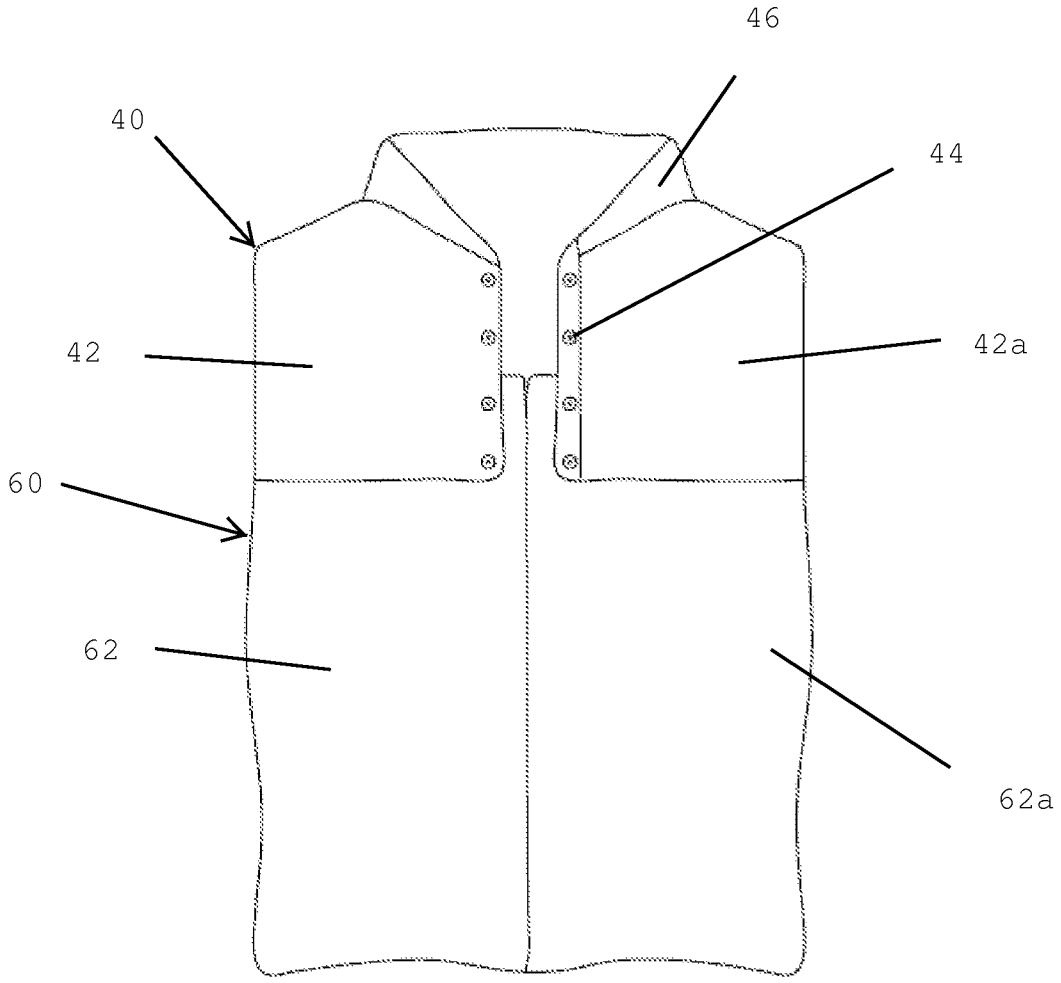
FIG. 6 is a front view of garment 10 having upper fastening means 44 in the open position and lower portion assembly 60 in the closed position. Sleeve assembly 20 is tucked inside upper portion assembly 40, and therefore not shown.

As shown in FIG. 6, lower portion assembly 60 includes lower flaps 62; 62*a*. Lower portion assembly 60 further includes lower flap fastening means 64 that fastens lower flap 62 to lower flap 62*a*. An alternate embodiment can be used wherein lower flaps 62; 62*a* are secured to areas of inner surface 15 corresponding to each lower flap's side so as to permit a user to close on side of lower flap assembly 40 while opening the opposite side of lower flap assembly 40.

Figure 7:
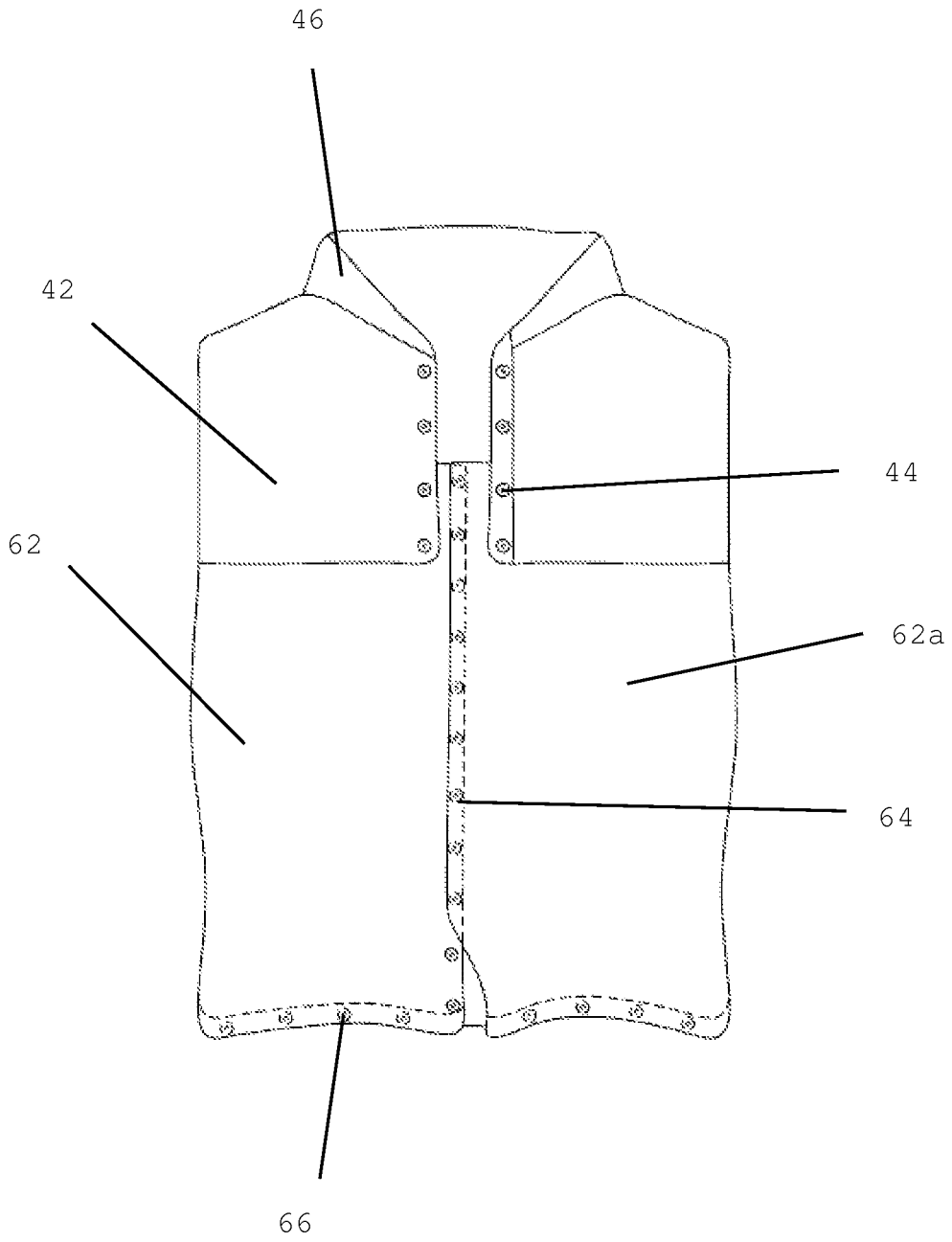
FIG. 7 is a front view of garment 10 having top fastening means 44 open keeping upper flaps 42; 42*a* from being attached to each other. Lower flap 62*a* is partially see-through to reveal lower flap fastening means 64. In this embodiment, lower flap fastening means 64 are snap buttons.

As shown in FIG. 7, lower portion assembly 60 can include lower garment fastening means 66 that allow a user to close the bottom distal ends of the garment, thereby allowing an infant to be entirely enclosed within the garment.

Figure 8:
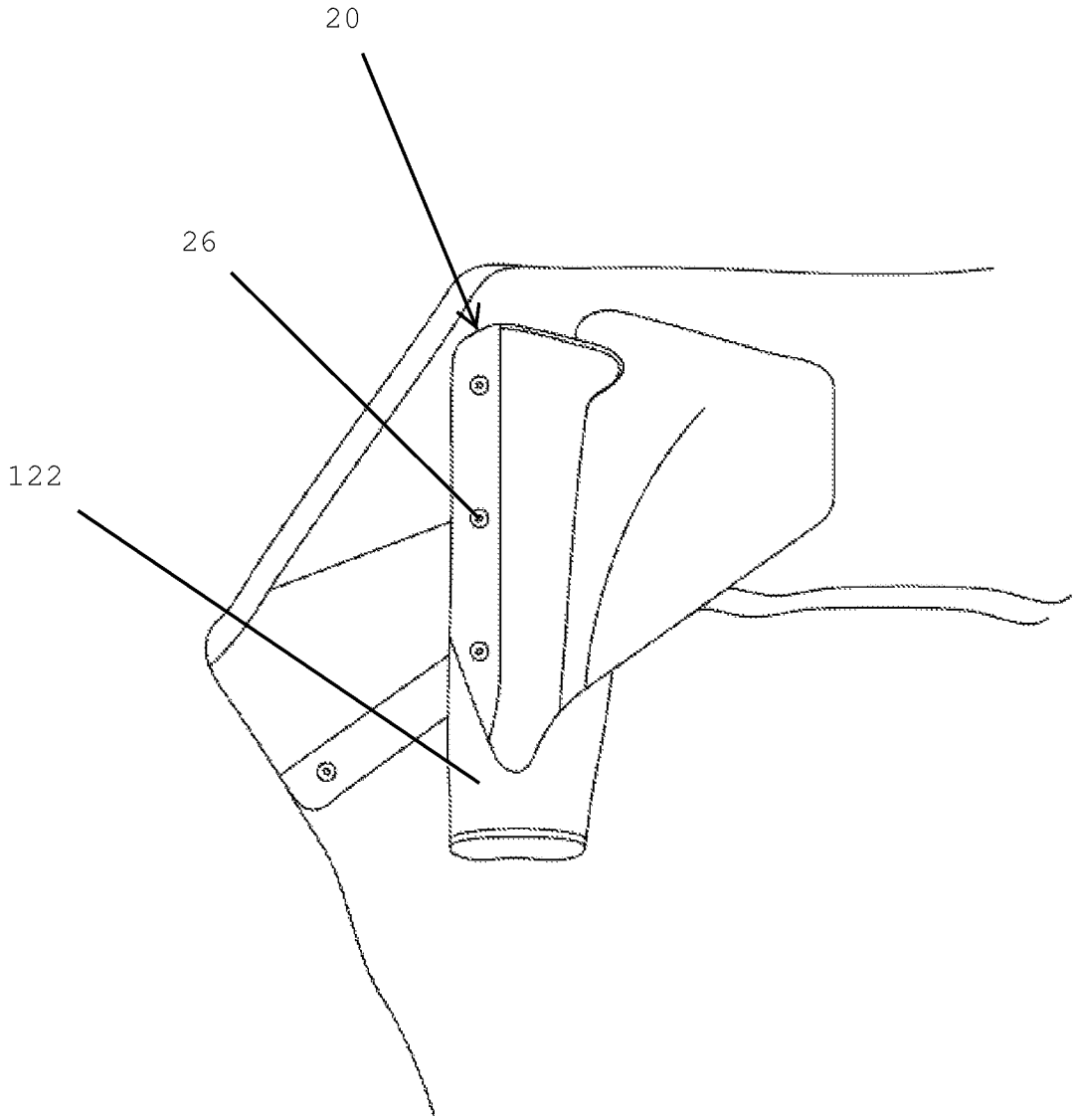
FIG. 8 illustrates an alternate embodiment of the present invention wherein short sleeve 122 is used in sleeve assembly 20.
Figure 10:
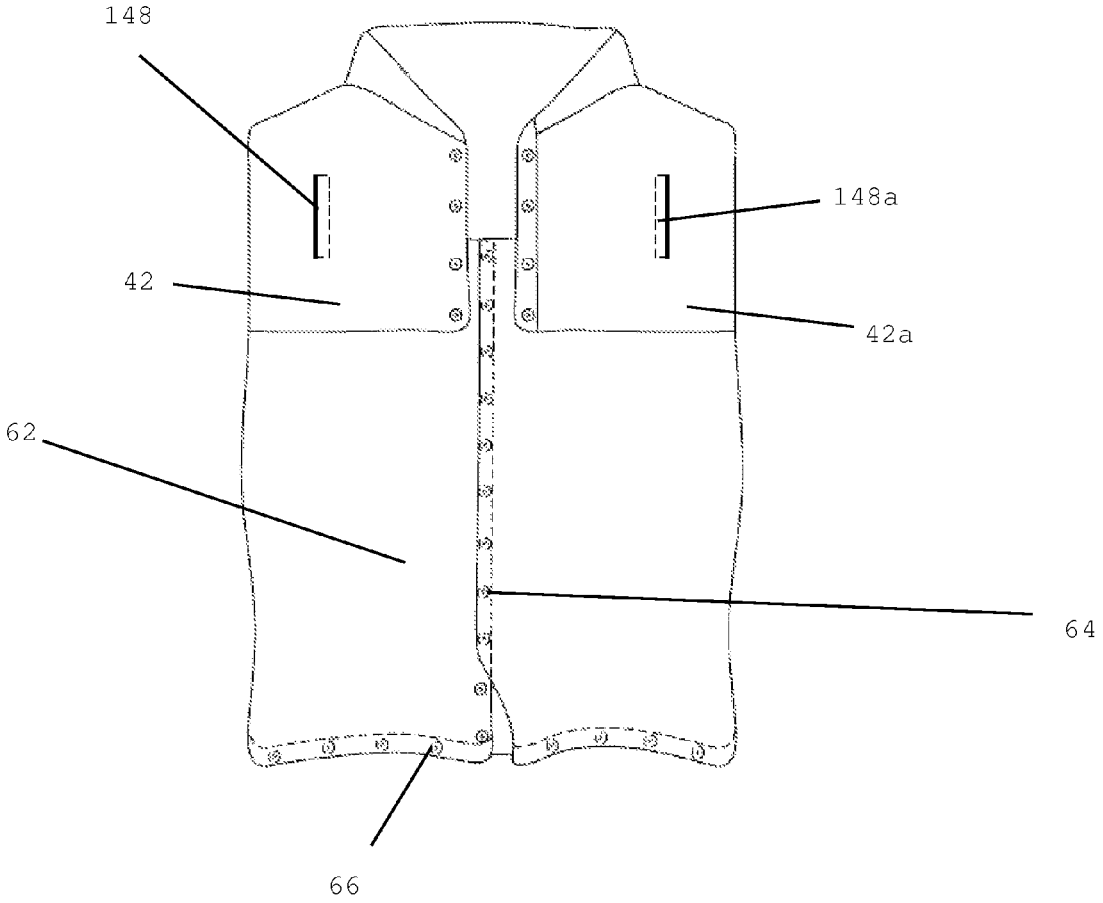
FIG. 10 represents a front view of an alternate embodiment of the garment having upper flaps 42; 42*a* in the open position and having openings 148; 148*a* that allow an infant to extend his or her arms out of front of upper portion assembly 40.

In an alternate embodiment, shown in FIG. 8, short sleeve 122 can be used in place of sleeves of a longer length. A complementing short sleeve is used in this embodiment on the other side of the garment not shown in FIG. 8. In yet another alternate embodiment shown in FIG. 10, openings 148; 148*a* can be implemented into upper flaps 42; 42*a* respectively, to permit a user to pass sleeves 22; 22*a* through the front of the garment. This allows a more versatile range of motion while maintaining the rest of the infant's torso selectively covered.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A garment, comprising of:

a) two bottom portions of equal dimensions that are made of a material and meet at the center of the front of said garment;

b) two top portions of equal dimensions that are made of the material and meet at said center of said front of said garment, said top portions partially overlapping said bottom portions;

c) said top portions include two front openings and two side openings to allow a user to extend two sleeves through the front or left and right sides of said top portions;

d) means for fastening said top portions to said bottom portions along the inner distal ends of said top portions thereby permitting a user to close first of said two top portions while maintaining second of said top portions open, wherein means for fastening said top portions are snap buttons, sew-through buttons or hook and loop fasteners;

e) means for fastening said bottom portions to said garment's inner surface along the inner distal ends of said bottom portions thereby permitting a user to close first of said two bottom portions while maintaining second of said bottom portions open, wherein means for fastening said bottom portions are snap buttons, sew-through buttons or hook and loop fasteners;

f) said top portions having an inner surface, said garment having an outer surface defined by said two top portions and said two bottom portions, means for fastening said bottom portions to said inner surface of said garment along the bottom distal ends of said bottom portions thereby adapted to enclose the body of an infant within said garment, wherein said means for fastening are snap buttons sew-through button, or hook and loop fasteners, said fastening means being on the material and having complementing fastening means located at the distal-most portion of said garment;

g) said inner surface having two sleeves attached thereto.

2. The garment set forth in claim 1 wherein fastening means for said sleeves and said top and bottom portions are snap buttons.

3. The garment set forth in claim 1 wherein fastening means for said sleeves and said top and bottom portions are hook and loop fasteners.

4. The garment set forth in claim 1 wherein said garment includes a collar.

5. The garment set forth in claim 1 wherein said top portions can be mounted to each other using snap buttons.

6. The garment set forth in claim 1 wherein said bottom portions can be mounted to each other using hook and loop fasteners.

7. The garment set forth in claim 1 wherein hand covers are mounted to the distal ends of said sleeves.

8. The garment set forth in claim 1 wherein the length of said sleeves can be shortened to a predetermined length.

9. The garment set forth in claim 1 wherein said sleeves include snap buttons configured to selectively allow a user to expose predetermined parts of an infant while maintaining the rest of said sleeves closed.

10. The garment set forth in claim 1 wherein said side openings of said top portions can be selectively closed using snap buttons.

* * * * *